United States Patent [19]

Kent

[11] Patent Number: 4,864,752

[45] Date of Patent: Sep. 12, 1989

[54] DISPLAY MEMBER

[76] Inventor: Roger S. Kent, 5 Ludwig Place, Duncraig, Australia

[21] Appl. No.: 86,148

[22] PCT Filed: Oct. 2, 1986

[86] PCT No.: PCT/AU86/00286

§ 371 Date: May 26, 1987

§ 102(e) Date: May 26, 1987

[87] PCT Pub. No.: WO87/02167

PCT Pub. Date: Apr. 9, 1987

[30] Foreign Application Priority Data

Oct. 3, 1985 [AU] Australia ..... PH2743

[51] Int. Cl.[4] ..... G09F 19/00

[52] U.S. Cl. ..... 40/477; 40/439

[58] Field of Search ..... 40/406, 407, 411, 412, 40/326, 439, 447, 450, 454, 477

[56] References Cited

U.S. PATENT DOCUMENTS

| | | | |
|---|---|---|---|
| 2,173,316 | 9/1939 | Sproule | 340/84 |
| 3,346,977 | 10/1967 | Rydstrom | 40/477 |
| 3,372,501 | 3/1968 | Greene | 40/477 |
| 3,400,478 | 9/1968 | O'Keefe | 40/477 |
| 4,178,077 | 12/1979 | Te Velde | 40/477 |
| 4,693,025 | 9/1987 | Landin | 40/439 |

FOREIGN PATENT DOCUMENTS

| | | | |
|---|---|---|---|
| 28321 | 9/1931 | Australia | 40/326 |

*Primary Examiner*—Gene Mancene
*Assistant Examiner*—Michael Lynch

[57] ABSTRACT

The invention concerns an improvement in a display member of the type comprising a plurality of reference members (14) accommodated within a common chamber (11) filled with an opaque fluid wherein each reference member is independently movable between a display position at which it is in face to face engagement with a display face (12) of the chamber (11) and a non-display position at which it is out of engagement with the display face. The improvement comprises each reference member (14) being associated with a boundary wall (19) which surrounds the sides of the reference member when at its non-display and/or display position. The function of the boundary wall (19) is to direct fluid entering or escaping from the space between the reference member and a face of the chamber adjacent the boundary member.

10 Claims, 2 Drawing Sheets

DISPLAY MEMBER

This invention relates to a display member capable of providing a variable display.

In particular the invention relates to a display member of the form disclosed in the International Patent Application PCT/AU83/00177 (WO84/02414).

It has been found that display members of this form suffer from the difficulty that on movement of one reference member between either of its end states the fluid flow produced can result in the displacement of adjacent reference members where a common chamber is used.

It is an object of this invention to at least partially overcome the above difficulty.

In one form the invention resides in an improvement in a display member on the type comprising a plurality of reference members accommodated within a common chamber filled with an opaque fluid wherein each reference member is independently movable between a display position at which it is in face to face engagement with a display face of the chamber and a non-display position at which it is out of engagement with the display face and wherein each reference member is associated with a boundary wall which at least partially surrounds the sides of the display member when at its non-display and/or display position.

According to a preferred feature of the invention the edges of the reference member are chamfered.

In another form the invention resides in an improvement in a display member of the type comprising a plurality of reference members accommodated within a common chamber filled with an opaque fluid wherein each reference member is independently movable between a display position at which it is in face to face engagement with a transparent display face and a non-display position at which it is out of engagement with the display face, said improvement comprising the edges of the display face being bevelled to produce a lens-like effect and magnify the adjacent edges of reference members at the edge of the chamber when in display position.

The invention will be more fully understood in the light of the following description of one specific embodiment. The description is made with reference to the accompanying drawings of which:

Figure 1:
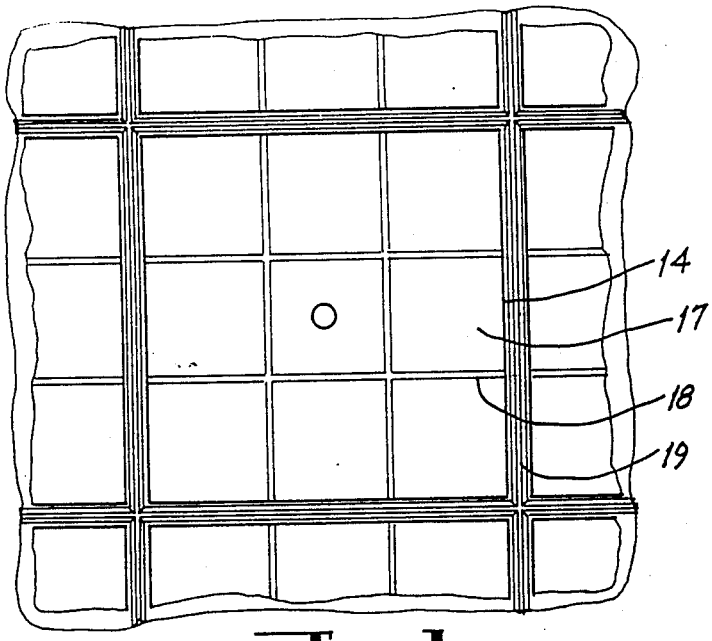
FIG. 1 is a partial front view of the display member according to the embodiment.
Figure 2:
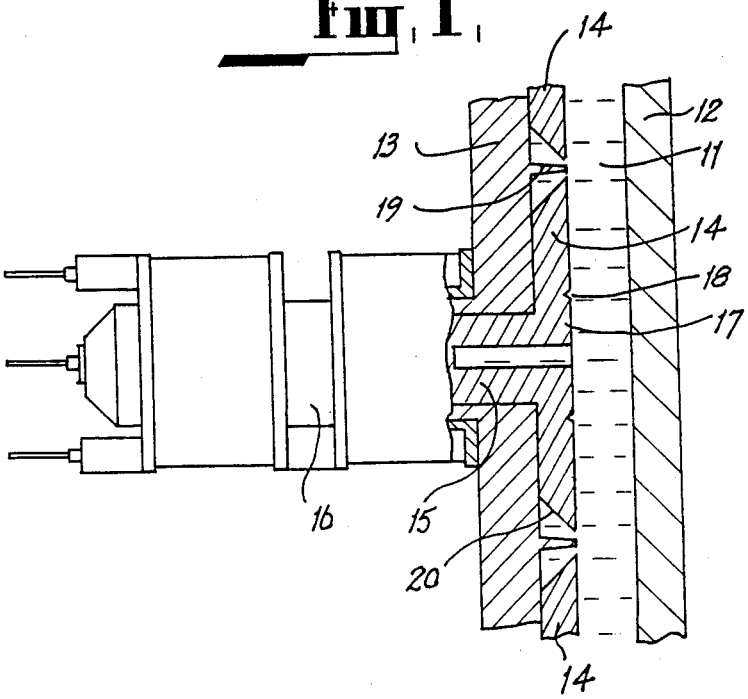
FIG. 2 is a part sectional elevation of the embodiment.

The embodiment relates to a display member comprising a chamber 11 defined between a pair of substantially parallel walls wherein one wall 12 is substantially transparent and defines the front display face of the chamber and the other wall 13 defines the rear wall of the chamber. The chamber 11 accommodates a plurality of substantially square lamina shaped reference members 14 which are supported within the chamber to form an array and are independently movable between the front wall 12 and the rear wall 13. Each refrence member 14 is formed with a rearwardly extending spigot 15 which is accommodated within a rearwardly extending tubular formation 16 on the rear face of the rear wall 13 to be slidably accommodated therein. A suitable drive means is provided between the spigot 15 and the tubular formation 16 to effect controlled movement of the reference member 14 between a display position at which it is in face to face engagement with the front wall and a non-display position at which it is in face to face engagement with the rear wall 13. The chamber 11 is filled with an opaque liquid which facilitates the invisibility of the reference member 14 when in its non-display position.

The display face 17 of the reference member 14 is formed with a plurality of grooves which extend across the face of the reference member 14 and open at the sides thereof. The function of the grooves is to provide a means whereby fluid between the display face 17 and the front wall 12 on movement of the reference member 14 towards the front wall 12 can escape from therebetween to facilitate more rapid movement of the reference member 14 to its display position. In addition the grooves 18 serve to reduce but not eliminate the surface tension and/or the adhesive and/or cohesive forces between the display face 17 and the front wall 12 to reduce the forces required for withdrawal of the reference member 14 from the front wall 12.

The rear wall 13 is formed with a plurality of flanges which extend from the face of the rear wall 13 to define a boundary wall 19 surrounding each reference member 14 when in their non-display position. The function of the boundary wall 19 is to direct fluid entering or escaping from the space between the display member 14 and the rear wall 13 on movement of the display member 14 towards the rear wall 13, outwardly from the rear wall 13. The resultant fluid flow is directed away from adjacent reference members 14 which may be in the non-display mode. As a result of the boundary wall 19 any fluid escaping from between or into the space between a reference member 14 and the rear wall 13 does not directly effect the corresponding space for adjacent reference members which may also be in their non-display position or moving to that position. The movement of the fluid between the reference member 14 and the rear wall 13 is further controlled by forming a rearwardly inclined chamfer 20 on the sides of the reference member 14. The effect of this chamfer ensures that when a reference member is in its display mode any fluid flow over its rear face resulting from the movement of adjacent reference members produces a movement tending to force the reference member into engagement with the display face.

If desired the rear face of the front wall 12 may also be formed with a boundary wall similar to the boundary wall 19 on the rear wall 13 in order to control the entry and exit of fluid between the display member 14 and the front wall 12 on movement of the display member 14. Alternatively the boundary wall may extend across the space between the front and rear walls and be discontinuous to facilitate controlled fluid transfer through the chamber which will not displace the adjacent reference members. In addition the edges of each reference member 14 may also be formed with a forwardly inclined chamfer.

Figure 3:
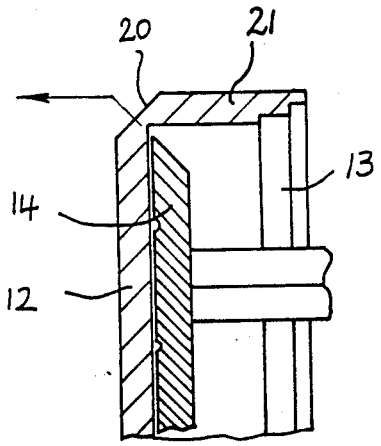
FIG. 3 is a part sectional elevation of an edge of the embodiment.

As a further feature the embodiment provides for the provision of a bevelled edge 20 at the sides of the display face as shown at FIG. 3. The bevelled edge produces a lens-like refraction of light which results in adjacent edges of the reference member at the edge of the chamber being magnified to produce an image whereby the boundary wall 21 of the display face is significantly reduced and the adjacent edges of the reference member are enlarged. In addition the transparent display face may be configured to have a lens-like effect and magnify the image of the reference members when in their display mode.

It should be appreciated that the scope of the present invention need not be limited to the particular scope of the embodiment described above.

The claims defining the invention are as follows:

1. An improvement in a display member of the type comprising a plurality of rigid reference members accommodated within a common chamber filled with an opaque fluid defined on one side by a display face and on the other side by an opposing face wherein each rigid reference member is independently movable between a display position at which it is in face to face engagement with said display face of the chamber and a non-display position at which it is out of engagement with said display face, said improvement comprising each reference member being associated with a boundary wall fixed within said chamber in a position which surrounds the sides of the reference member when in one of its positions to redirect the movement of fluid displaced from the area between said reference member and the respective face as said reference member moves to said one position and direct the displaced fluid away from adjacent reference members so as not to displace such adjacent members.

2. An improvement as claimed in claim 1 wherein the opposing face is engaged by the reference member when in its non-display position and said boundary wall extends outwardly from said rear face.

3. An improvement as claimed at claim 2 wherein the boundary wall extends between the space between the rear face and the display face.

4. An improvement as claimed at claim 1 wherein the boundary wall extends rearwardly from the display face.

5. An improvement as claimed at claim 1 wherein the edges of the reference member are chamfered.

6. An improvement as claimed at claim 5 wherein the chamfer is formed on the rear face of the reference member.

7. An improvement as claimed at claim 1 wherein the edges of the display face are bevelled to produce a lens-like effect and magnify the adjacent edges of reference members at the edge of the chamber when in their display position.

8. An improvement as claimed in claim 1 wherein said display face is configured to have a lens-like effect and magnify the image of the reference members when at their display position.

9. An improvement in a display member of the type comprising a plurlaity of rigid reference members accommodated within a common chamber filled with an opaque fluid and defined on one side by a display face and on the other side by an opposing face wherein each rigid reference member is independently movable between a display position at which it is in face to face engagement with said display face of said chamber and a non-display position at which it is out of engagement with said display face, the improvement comprising each reference member having its side edges chamfered for generating a fluid force upon said reference member acting toward its display position in response to movement of adjacent reference members by the fluid displaced by the adjacent reference member to its display position.

10. An improvement as claimed in claim 9 wherein the chamber opposing face is engaged by a the reference members when in their non-displayed position and the reference members are chamfered on both sides thereof so that the displaced fluid retains said reference members in each of their positions.

* * * * *